US005252791A

United States Patent [19]

Williams

[11] Patent Number: 5,252,791

[45] Date of Patent: Oct. 12, 1993

[54] IGNITION SWITCH

[75] Inventor: Thomas D. Williams, Mentor, Ohio

[73] Assignee: Delta Systems, Inc., Streetsboro, Ohio

[21] Appl. No.: 771,059

[22] Filed: Oct. 2, 1991

[51] Int. Cl.[5] ..... H01H 21/62

[52] U.S. Cl. ..... 200/11 C; 200/43.08

[58] Field of Search ..... 200/11 R, 11 C, 11 EA, 200/11 G, 11 J, 11 K, 11 A, 43.08, 283, 284

[56] References Cited

U.S. PATENT DOCUMENTS

| | | | |
|---|---|---|---|
| 2,231,325 | 2/1941 | Douglas | 200/11 J X |
| 2,549,998 | 4/1951 | Allison | 200/11 A |
| 2,601,398 | 6/1952 | Jacobi | 200/11 EA |
| 2,715,661 | 8/1955 | Miller | 200/11 C X |
| 2,778,891 | 1/1957 | Jacobi | 200/11 C |
| 3,311,718 | 3/1967 | Allison et al. | 200/11 K |
| 3,497,644 | 2/1970 | Schink et al. | 200/11 C |
| 3,676,617 | 7/1972 | Miller | 200/43.08 |
| 3,900,709 | 8/1975 | Sheesley et al. | 200/11 R X |
| 3,944,761 | 3/1976 | Nicholl et al. | 200/11 EA |
| 3,996,431 | 12/1976 | Brown | 200/16 C |
| 4,016,387 | 4/1977 | Aberer | 200/11 R X |
| 4,292,483 | 9/1981 | Roytberg | 200/43.03 |
| 4,328,401 | 5/1982 | Carr | 200/11 R |

*Primary Examiner*—J. R. Scott

*Attorney, Agent, or Firm*—Watts, Hoffman, Fisher & Heinke Co.

[57] ABSTRACT

A key switch comprises a disc-shaped switch contact suspended above a number of stationary terminals. The switch contact includes one or more cut-outs which isolate individual terminals in different angular orientations of the contact. The signals conducted through each terminal vary as different combinations are bridged by the contact in different angular orientations. By changing the pattern of the cut-outs through the contact, the signals conducted through the switch are changed. The switch is efficient to produce because it can be adapted to different circuits without substituting physically different terminal pieces.

8 Claims, 7 Drawing Sheets

IGNITION SWITCH

TECHNICAL FIELD

The present invention relates generally to electrical switches for controlling the operation of lawn and garden equipment or other motorized equipment, and more specifically to key-actuated rotary switches adapted to control the ignition circuits of lawn and garden equipment.

BACKGROUND ART

It is common for lawn and garden equipment such as garden tractors or riding lawn mowers to have internal combustion engines with electric ignition systems. The electric ignition systems of garden tractors are usually powered by batteries carried on the equipment. The flow of electricity from the batteries to the ignition systems is often controlled by key-actuated rotary switches like those found on automobiles.

The rotary ignition switches found on garden tractors generally have either three or four switching states. In the "off" state, the engine magneto is grounded and the tractor does not run. The "run" state, as the name implies, is the state in which the tractor does run. In the "start" position, the starter solenoid is active to start the engine running. The lights may be connected to the battery in the "run" state, or a separate "run/lights" state may be provided in which the lights are activated. Other accessories on the tractor, such as the blade clutch in the case of a riding lawn mower, are coupled to the battery by means of separate power take-off switches in series with the rotary ignition switch.

These rotary switches are "turned" to the "off," "run" or "start" state by means of keys which engage shafts inside the housings of the switches. Spring-biased detents are often incorporated into the shafts and housings so that the shafts remain in the "off," "run" or "run/lights" orientations after the operator releases the key. An additional spring is often incorporated to bias the switch away from the "start" state, so that the switch will revert from the "start" state to the "run" or "run/lights" state after the key is released.

Each input or output of the ignition switch, such as the ground, the battery, the engine magneto, the lights and the starter solenoid, is assigned to a separate switch terminal. The layouts of such ignition circuits vary from manufacturer to manufacturer and from model to model. Consequently, a single parts supplier may be called upon to provide a variety of rotary switches having the same housing but different terminal assignments or different combinations of terminals bridged in the "off," "run," "run/lights" or "start" states.

U.S. Pat. No. 3,497,644 to Schink et al. proposed rotary switch for controlling a garden tractor ignition circuit which included a terminal board mounting a number of active and dummy terminal points in a circle around a central axis. An hour-glass shaped contact was rotatable about that axis and bridges exactly three of the active or dummy terminal points in "off," "run" and "start" angular orientations. Outwardly-extending prongs arranged for connection with the external inputs and outputs were fabricated with integral straps which ran along the lower surface of the terminal board to connect the terminal points with prongs. Additional straps were provided on the upper or lower surface of the terminal board to couple active terminal points where the same terminal prong was to be active in more than one orientation of the contact. In order to change the assignment of the terminals, it was necessary to use a different set of straps and prongs connecting different prongs with different terminal points.

As a general rule, the parts supplier must be able to ship large quantities of switches in a short time to meet the manufacturing schedules of the lawn and garden manufacturer. This requires the parts supplier to maintain an inventory of switches or switch components which can be assembled and shipped on short notice. The inventory which the parts supplier must maintain in order to meet short deadline orders is exacerbated by the need to maintain different styles of terminals, terminal plates and straps in order to meet the needs of different manufacturers and models of equipment.

DISCLOSURE OF THE INVENTION

A novel key switch comprises a disc-shaped switch contact positioned relative to a number of stationary terminals. The switch contact includes one or more cut-outs which isolate individual terminals in different angular orientations of the contact. The signals conducted through each terminal vary as different combinations are bridged by the contact in different angular orientations. By varying the pattern of the cut-outs through the switch contact, different combinations of terminals are bridged for any given orientation of the contact.

Each terminal consists of a prong, a head extending perpendicularly from the prong, and a dome rising from the head to define a point for engagement with the switch contact. The terminal prongs may be pressed into slots in the terminal board and frictionally retained without the use of fasteners or bonding agents.

The significance of these improvements is best appreciated by reference to the manufacture of three-state ignition switches having the same spacial arrangement of terminals but different terminals assignments or combinations of terminals bridged in the "off," "run" or "start" states. In the prior art switch described previously, it would have been necessary to use different styles of terminal heads and prongs for different models of lawn and garden equipment. According to the novel design, one need only change the switch contact and perhaps reverse the direction of one or more of the terminals in order to accommodate the different manufacturers' ignition circuits. Identical terminal boards and terminals are used in each case, and the only item which must be duplicated in inventory is the switch contact.

In a preferred embodiment of the switch, the switch contact is enclosed by a housing and turned by means of a shaft having an end exposed to the exterior of the housing through an opening. The exposed end of the shaft includes a key hole for receiving a key which may be used to turn the shaft and switch contact. The housing is secured at its base to the terminal board in order to form a moisture-tight seal around the switch mechanism.

Either the interior surface of the housing or the exterior surface of the shaft mounts a detent which engages a recess on the other to stabilize the switch contact in the "off," "run" and "run/lights" positions. A compression spring or other means acting parallel to the axis of the shaft is provided for biasing the detent and recess into engagement. By forming the detents integrally with the shaft and housing, and providing a single spring beneath the shaft, it is possible to reduce the number of component parts of the switch in comparison to prior art switches having independent detent balls or bullets each separately biased against the interior of the housing.

From the foregoing, it is clear that one object of the invention is to provide a rotary switch which is easier and more cost effective to manufacture than those known in the prior art. Still other features and advantages and a full understanding of the invention will become apparent to those skilled in the art from the following description of the best mode and the accompanying drawings.

BEST MODE FOR CARRYING OUT THE INVENTION

Figures 1, 2:
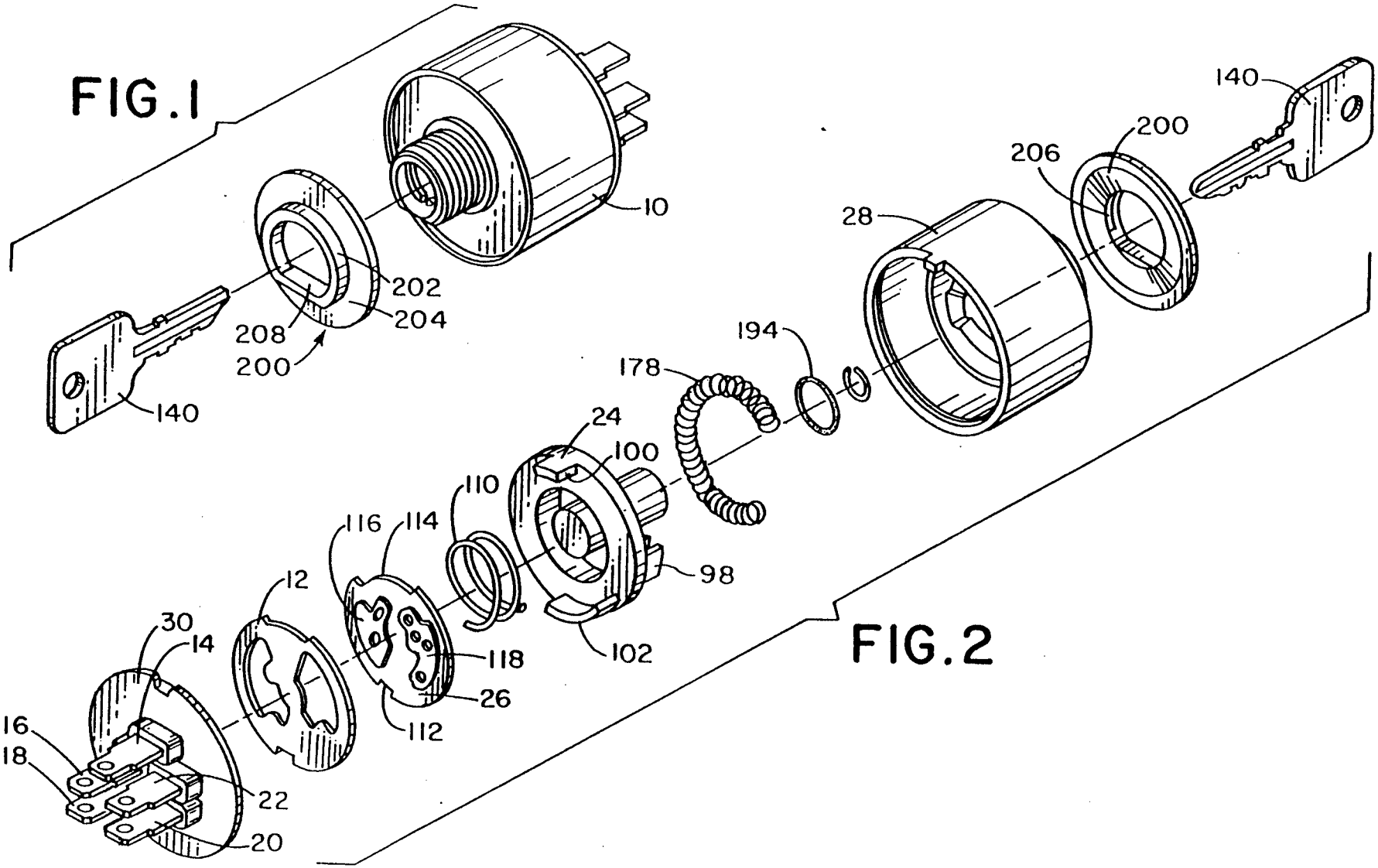
FIG. 1 is a perspective view of a key switch, a bezel for use in mounting the switch and a key for actuating the switch.
FIG. 2 is a disassembled view of the key switch of FIG. 1.

A three-state key switch 10 shown in FIGS. 1 and 2 includes a switch contact 12 which is suspended over five switch terminals 14, 16, 18, 20, 22. The switch contact 12 is turned by means of a shaft 24, which engages an insulator 26 fixed to the switch contact 12. The shaft 24 is borne inside a housing 28, which houses the switch contact 12; portions of the terminals 14, 16, 18, 20 and 22; the shaft 24 and the insulator 26. The terminals 14, 16, 18, 20 and 22 are positioned by a terminal board 30 which cooperates with the housing 28 to form a moisture-tight seal for the components of the switch 10.

Figure 9C:
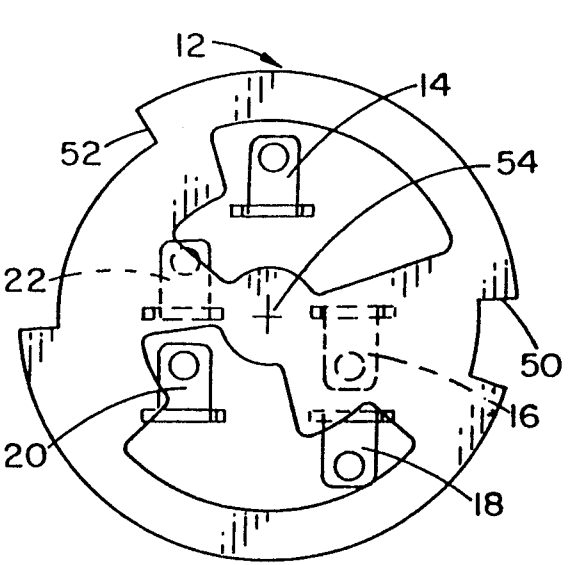
FIGS. 9A–9C are schematic views showing a switch contact for a three-state ignition switch of FIG. 2 in the "off," "run" and "start" orientations, respectively.
Figure 9B:
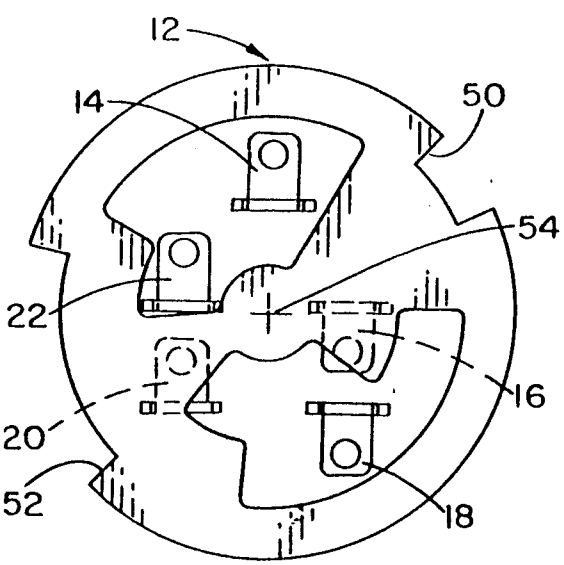
Figure 9A:
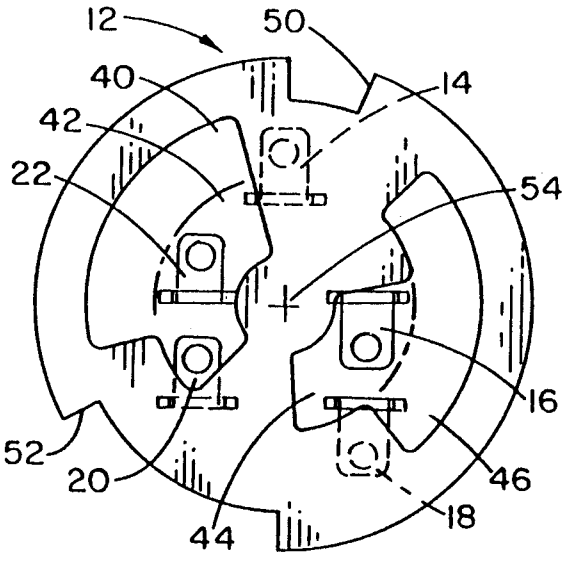

FIGS. 9A–9C and 10A–10C show different embodiments of the switch contact 12, 12' in relation to the terminals 14, 16, 18, 20, 22. As best seen in FIG. 9A, the switch contact 12 is a metal disc, preferably copper, having four cutouts 40, 42, 44, 46 interior to its circumference and a pair of asymmetric slots 50, 52 along its circumference. The cut-outs 40, 42, 44, 46 are each in the form of circular arcs concentric with the central axis 54 of the switch contact 12. As shown in FIG. 9A, the cut-outs 40, 42 are adjacent one another and form a continuous hole in the contact 12. Simlarly, the cut-outs 44, 46 form a continuous hole in the contact 12. The switch contact 12 shown in FIGS. 9A–9C is designed for a three-state switch (e.g., "off," "run" and "start"), but it is also possible to design a switch contact for a four-state switch (e.g., "off," "run," "run/lights" and "start") by means of a different arrangement of cut-outs in the contact.

Figure 11:
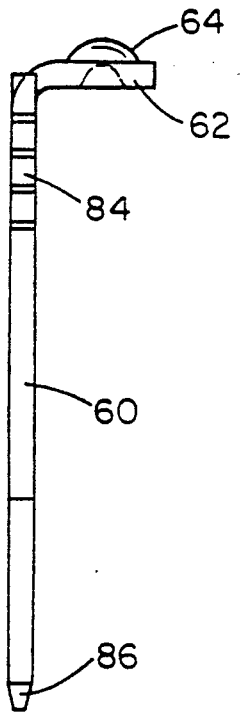
FIGS. 11 and 12 are elevational views of terminals for the switch of FIG. 2.
Figure 12:
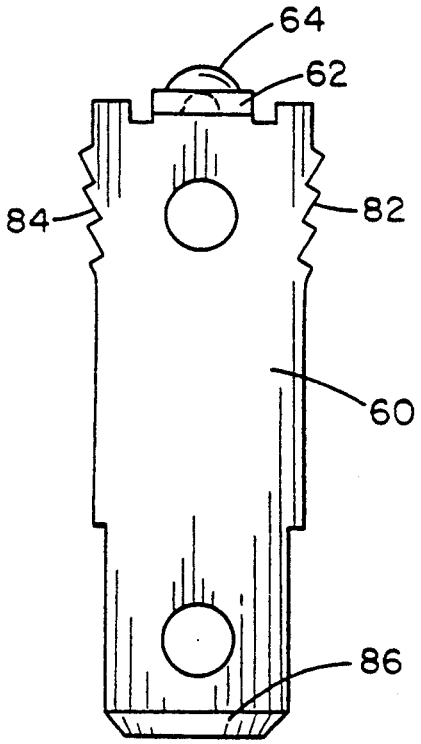

The terminals 14, 16, 18, 20, 22 (FIGS. 11 and 12) are identical in structure and consist of L-shaped strips of metal. Each includes a terminal prong 60, a head 62 extending at a right angle from the prong 60 and a dome 64 seated on the head 62. The dome 64 acts as a contact point with the switch contact 12, while the prong 60 extends through the terminal board 30 for contact with an external circuit (not shown) such as an ignition circuit of a garden tractor. The prong 60, head 62 and dome 64 are formed integrally by means of stamping or coining to form a continuous electrically-conductive piece.

Figure 13:
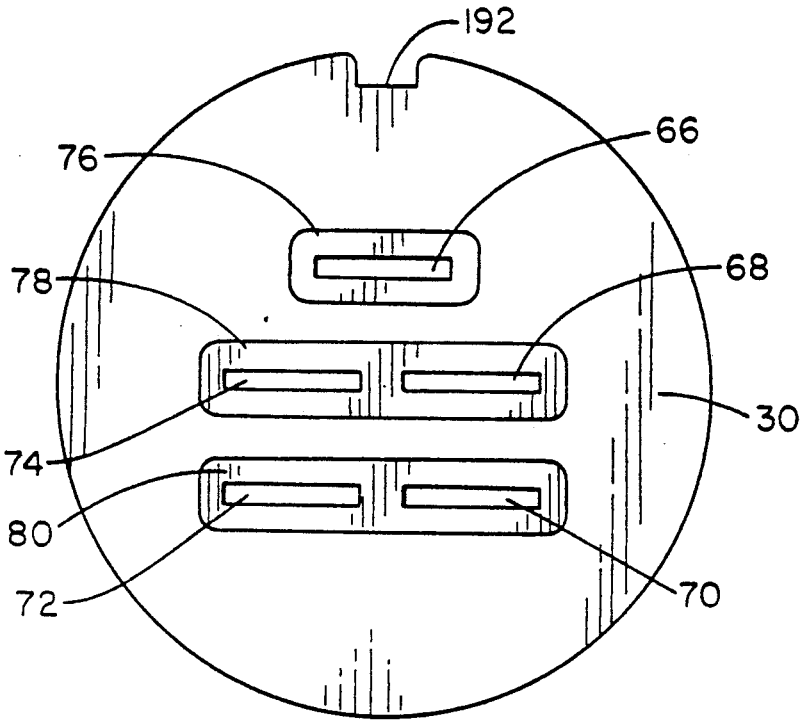
FIG. 13 is an elevational view of a terminal board for the switch of FIG. 2.

The terminals 14, 16, 18, 20, 22 are supported and positioned relative to the switch contact 12 by means of a terminal board 30 (FIG. 13). The terminal board 30 includes a plurality of holes 66, 68, 70, 72, 74 for receiving and frictionally retaining the prongs 60 of the terminals 14, 16, 18, 20, 22. The holes 66, 68, 70, 72, 74 are surrounded by sleeves 76, 78, 80 which provide additional surface area for frictional engagement with serrated portions 82, 84 along the sides of the prongs 60. The ends 86 of the prongs 60 are beveled, which simplifies their insertion into the holes 66, 68, 70, 72, 74.

Different combinations of the switch contacts 14, 16, 18, 20, 22 are bridged in different angular orientations of the switch contact 12. By way of example, FIGS. 9A–9C show the position of the switch contact 12 relative to the terminals 14, 16, 18, 20, 22 for an ignition switch having "off," "run" and "start" states. The switch of FIGS. 9A–9C is designed to ground the ignition circuit in the "off" state, switch on the lights in the "run" state, and switch off the lights and energize the starter solenoid in the "start" state. The assignment of the contacts is as follows:

| Terminal | Assignment |
|---|---|
| 14 | Engine Magneto |
| 16 | Battery |
| 18 | Ground |
| 20 | Lights |
| 22 | Starter Solenoid |

FIG. 9A represents the "off" state, in which the magneto and ground terminals 14, 18 are bridged and the remaining terminals 16, 20, 22 are isolated. FIG. 9B represents the "run" state, in state, in which the switch contact 12 is displaced 45° clockwise, bridging the battery and lights terminals 16, 20 and isolating the remainder 14, 18, 22. Finally, FIG. 9C represents the "start" state, in which the switch contact 12 is displaced 85° from the "off" position and the battery and starter solenoid terminals 16, 22 are bridged. In the "start" state, the lights terminal 20 is isolated so that the lights are turned off while the equipment is being started.

Figure 10C:
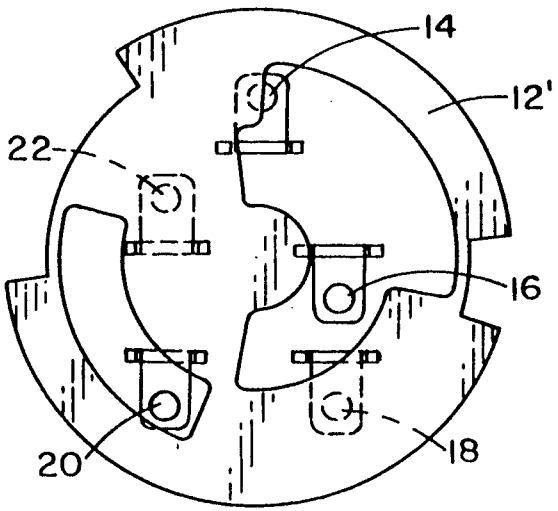
FIGS. 10A–10C are schematic views showing a switch contact for an alternative three-state ignition switch in the "off," "run" and "start" orientations, respectively.
Figure 10B:
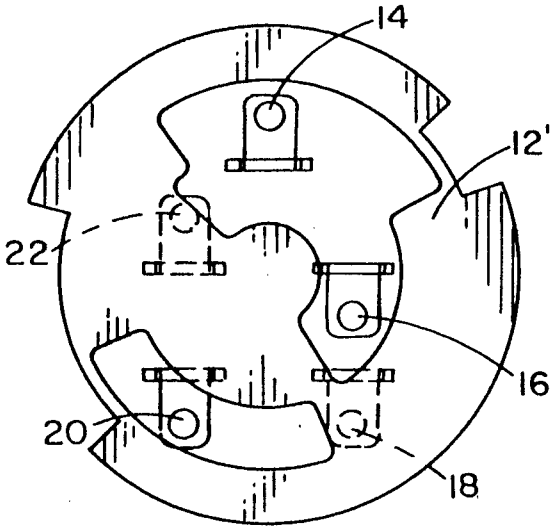
Figure 10A:
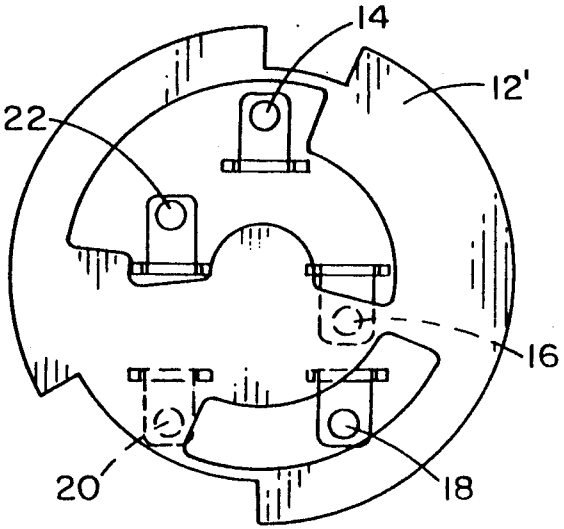

FIGS. 10A–10C show the position of the alternative switch contact 12' relative to the terminals 14, 16, 18, 20, 22 for an ignition switch which grounds the ignition circuit in the "off" state, turns on the lights in the "run" state and energizes the starter solenoid without turning off the lights in the "start" state. In FIGS. 10A–10C, the terminals are assigned as follows:

| Terminal | Assignment |
|---|---|
| 14 | Starter Solenoid |
| 16 | Engine Magneto |
| 18 | Lights |
| 20 | Ground |
| 22 | Battery |

Notwithstanding the different assignment of terminals, the structures and spacial arrangement of the terminals 14, 16, 18, 20, 22 are the same as the structures and spacial arrangement of the corresponding terminals in FIGS. 9A-9C, so that the terminals and terminal boards used in the switch illustrated schematically in FIGS. 9A-9C would be interchangeable with those used in the switch illustrated schematically in FIGS. 10A-10C. The only distinction in the terminals of the two switches is that the head of the terminal 20 is directed differently in the two switches.

FIG. 10A represents the "off" state, in which the magneto and ground terminals 14, 18 are bridged and the remaining terminals 16, 20, 22 are isolated. FIG. 10B represents the "run" state, in which the switch contact 12' is displaced 45° clockwise, bridging the battery and lights terminals 16, 20 and isolating the remainder 14, 18, 22. Finally, FIG. 10C represents the "start" state, in which the switch contact 12' is displaced 85° from the "off" position and the battery, lights and starter solenoid terminals 16, 22 are bridged. Unlike the switch illustrated schematically in FIGS. 9A-9C, the lights terminal 18 in the switch of FIGS. 10A-10C is coupled to the battery terminal 22 in the switch of FIGS. 10A-10C.

While two different switch contacts 12, 12' have been shown in FIGS. 9A-9C and 10A-10C, it should be kept in mind that there is no "best mode" of the switch contact which is superior in all applications. The precise shapes and arrangements of the cut-outs are determined by the assignment of the terminals 14, 16, 18, 20, 22; the radii of the terminal domes 64 from the center of the switch contact and the combinations of terminals 14, 16, 18, 20, 22 to be bridged in each angular orientation of the switch contact. It may be possible in some circumstances to control the order in which the terminals are engaged or disengaged by the switch contact by controlling the lengths of the cut-outs.

Figure 7:
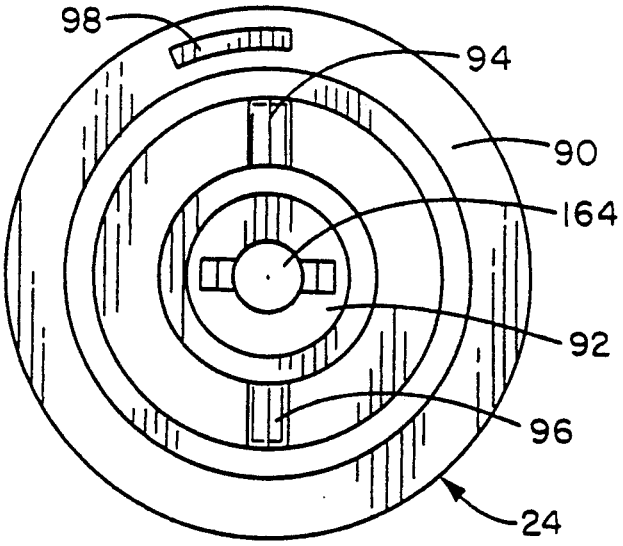
FIGS. 6–8 are elevational views of a shaft for the key switch of FIG. 2.
Figure 6:
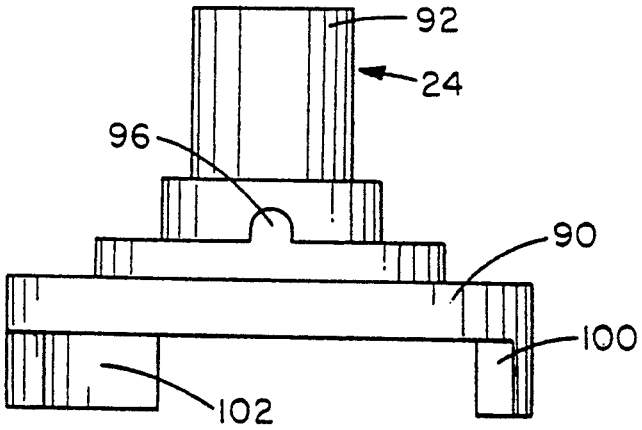
Figure 8:
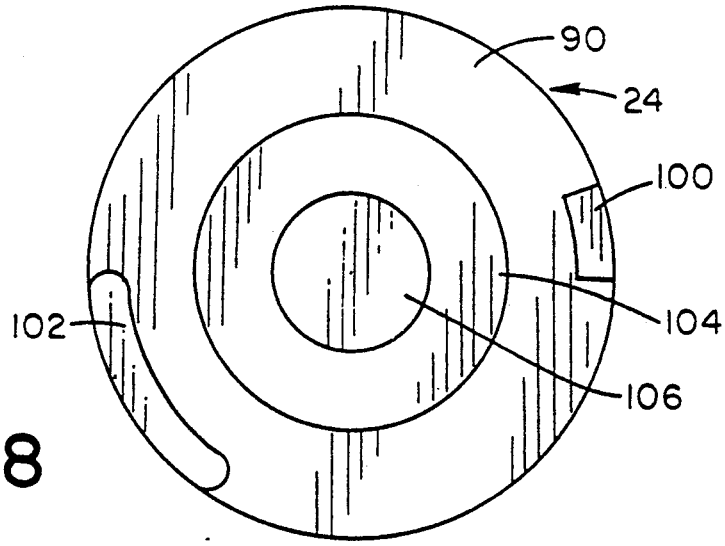

The shaft 24 and insulator 26 cooperate to transfer rotary motion to the switch contact 12 relative to the terminals 14, 16, 18, 20, 22. The shaft 24 (FIGS. 6-8) comprises a carriage 90 mounting an key-receiving journal 92, a pair of integral detents 94, 96 and a spring-compression tab 98 on one side and a pair of guide tabs 100, 102 on the opposite side. This opposite side of the carriage 90 includes a blind hole 104 with a central knob 106 for receipt of a coiled compression spring 110 (FIG. 2).

The insulator 26 is interposed between the carriage 90 and the switch contact 12 in order to protect and insulate the switch contact 12 from the spring 110. The insulator 26 (FIG. 2) consists of a flat disc with a knob (not shown) projecting from the side facing the shaft 24. The knob has a diameter just less than that of the spring 110, and cooperates with the blind hole 104 and knob 106 in the shaft to retain the spring 110 between the insulator 26 and shaft 24. The insulator 26 also includes a pair of asymmetric slots 114, 116 along its circumference similar to slots 50, 52 in the switch terminal 12.

The switch contact 12 is seated on the surface of the insulator 26 opposite the shaft 24 and is biased against the terminals 14, 16, 18, 20, 22 by the spring 110. The asymmetric slots 112, 114 in the insulator 26 and 50, 52 in the switch contact 12 engage the guide tabs 100, 102 projecting from the shaft 24 so that the insulator and switch contact are restrained to move linearly under the bias of the spring 110. The guide tabs 100, 102 and slots 50, 52, 112, 114 are asymmetric so that the contact can be installed in only one proper angular orientation relative to the shaft 24. The pattern of the cut-outs 40, 42, 44, 46 of the switch contact 12 are embossed on the side of the insulator 26 opposite the shaft 24, and these bosses 116, 118 project through the cut-outs 40, 42, 44, 46 to help insulate the terminals which are not in engagement with the switch contact 12 in a given orientation. The bosses 116, 118 include depressions which correspond roughly to the positions of the domes 64 of various of the terminals 14, 16, 18, 20, 22 relative to the switch contact 12 in the "off," "run" and "start" orientations of the contact 12.

Figure 3:
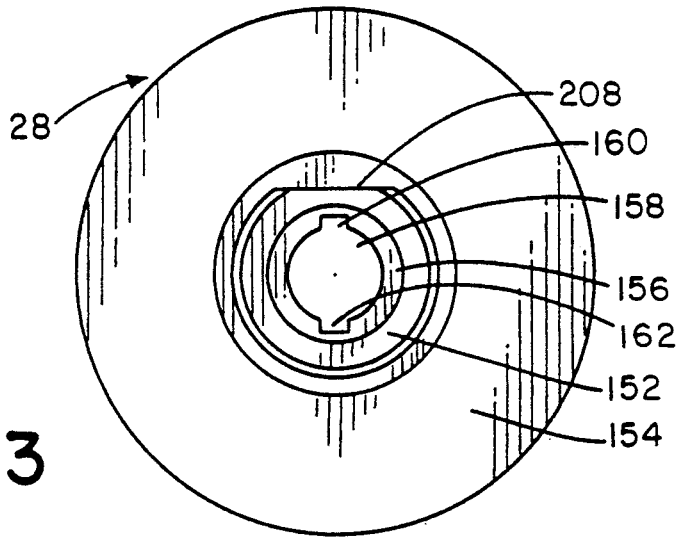
FIG. 3 is an elevational view showing the exterior of a housing for the key switch of FIG. 2.
Figure 5:
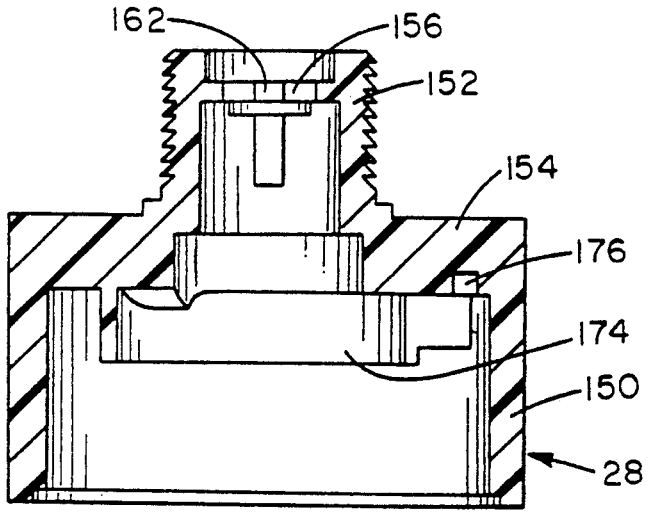
FIG. 5 is a sectional view as seen from the plane defined by the line 5—5 in FIG. 4.
Figure 4:
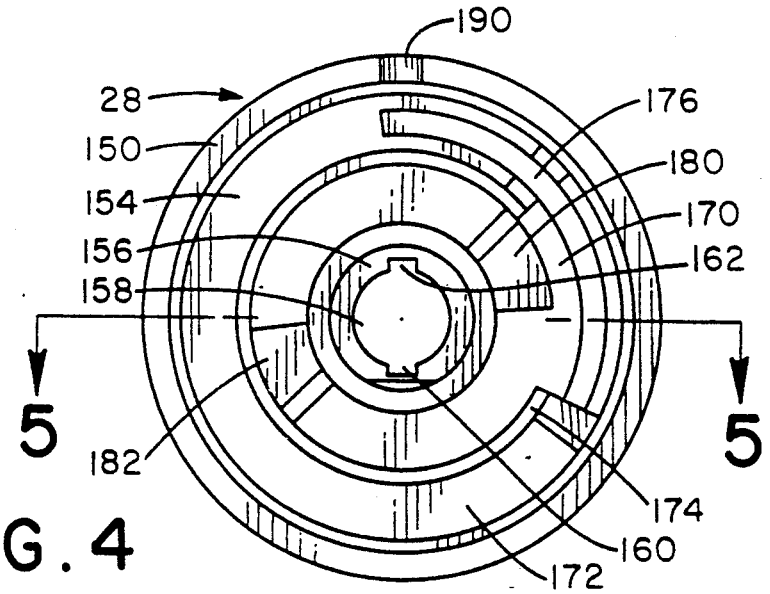
FIG. 4 is a elevational view showing the interior of the housing of FIG. 3.

The shaft 24 is rotatably supported by the housing 28 for rotation by means of a hand-held key 140 (FIGS. 1 and 2). The housing 28 (FIGS. 3-5) includes a hollow cylindrical body portion 150 and a narrower hollow cylindrical neck portion 152 joined by a radial flange 154. The body portion 150 encloses the switch contact 12, the insulator 26, the spring 110 and the carriage 90 (FIGS. 6-8) of the shaft 24, while the neck portion 152 acts as a sleeve bearing for the journal 92 of the shaft 24. Both the body portion 150 and the neck portion 152 are open at their ends opposite the flange 154. A web 156 having a circular hole 158 with a pair of diametrically opposed cut-outs 160, 162 is stretched across the opening in the neck portion 152.

The key 140 engages a key hole 164 (FIG. 7) in an end of the journal 92 of the shaft 24 exposed through the hole 158 in the web 156. At least a portion of the key hole 164 is dimensioned to provide a close fit with the key 140 so that the key 140 firmly engages the shaft 24. In order to operate the switch 10, the key 140 is inserted into the key hole 164 with the key's width passing through the cut-outs 160, 162. During the insertion of the key 140, the length of the key hole 160 is aligned with the cut-outs 160, 162. The diameter of the circular portion 158 is sufficiently small that the key 140 is retained in the key hole 164 after being turned. In terms of using the switch 10 as an ignition switch, these features imply that the key 140 may be freely inserted into the key hole 164 or removed when the switch 10 is in the "off" state, but will be retained in the switch 10 when the switch 10 is in the "run" or "start" state.

The spring-compression tab 98 (FIG. 6) projecting from the carriage 90 extends into and follows an annular channel 170 (FIG. 4) in the inner surface of the flange 154. The ends of the channel 170 serve as stops which limit the rotation of the shaft 24 in the housing 28 when the spring-compression tab 98 abuts these ends. In the preferred embodiment, one end of the channel 170 abuts an end wall of an pocket 172 (FIG. 5) defined on the surface of the flange 154 by a wall 174, while the other end of the channel 170 passes into the pocket 172 through an opening 176 in the wall 174. A coiled compression spring 178 (FIG. 2) is seated in the pocket 172 and acts against the spring-compression tab 98 when the tab 98 is moved in the channel 170 through the opening 176 into the pocket 172.

Two stable angular orientations of the shaft 24 and switch contact 12, corresponding to the "off" and "run" states of an ignition switch, are defined by the interaction of the integral detents 94, 96 on the shaft and a pair of flat-surfaced, wedge-shaped reliefs 180, 182 (FIG. 4) integral with the inner surface of the flange 154. One annular end of each of the reliefs 180, 182 is positioned so that the detents 94, 96 are adjacent these two ends when the spring-compression tab 98 abuts the wall 174 at one end of the channel 170; this condition defines a first stable orientation corresponding to the "off" state of an ignition switch. The remaining end of each of the reliefs 180, 182 is positioned so that a mild biasing force from the spring 178 holds the detents 94, 96 against the reliefs 180, 182; this second stable orientation corresponds to the "run" state of an ignition switch. Clearly, the heights of the reliefs 180, 182 and of the detents 94, 96 must be sufficient that the bias supplied by the spring 178 does not dislodge the shaft 24 from the second stable angular orientation.

The spring 110 biases the detents 94, 96 perpendicularly to the direction of rotation of the shaft 24 and switch contact 12 toward the flange 154 and into engagement with the reliefs 180, 182. In the preferred embodiment, the annular sides of the reliefs 180, 182 are rounded and provide a tangible "click" when the shaft 24 enters either of the two stable orientations. The surfaces of the reliefs 180, 182 between the between the sides are preferably flat to discourage the operator from turning the shaft 24 and the switch contact 12 only part-way between the two stable orientations (e.g., only part-way between the "off" and "run" positions). The reliefs 180, 182 are identical in height, which is determined by the torque to be applied to the key 140 to turn the shaft between the two stable orientations.

While two detents 94, 96 and two reliefs 180, 182 are shown in the preferred embodiment, the shaft 24 and inner surface of the housing 28 may include additional detents to define one or more additional stable orientations of the shaft 24 (e.g., a "run/lights" state). Alternatively, one or more of the detents 94, 96 or reliefs 180, 182 may be replaced by slots or other structure to provide biased engagement between the shaft 24 and housing 28 in selected orientations of the shaft 24.

A third angular orientation, corresponding to the "start" state of an ignition switch, is defined where the spring-compression tab 98 abuts the end of the channel 170 inside the pocket 172. In this orientation, the spring 178 is compressed. Once the operator turns the key 140 to this orientation and then releases the key 140, the spring 178 will bias the shaft 24 back toward the detents into the second stable orientation. In terms of an ignition switch, this corresponds to the switch automatically returning to the "run" position from the "start" position when the key is released. By way of contrast, there is no biasing force acting on the shaft 24 between the first and second angular orientations, and the switch remains in either the "off" or "run" positions after the key is released.

The opening in the body portion 150 of the housing 28 opposite the flange 154 is sealed by the terminal board 30, which fits across the opening. The housing 28 includes a tab 190 which engages a slot 192 in the side of the terminal board 30 to orient the terminal board 30 (and the terminals 14, 16, 18, 20, 22) relative to the housing 28 (which cooperates with the shaft 24 to determine the stable orientations of the switch contact 12). Preferably, a hermetic seal is formed between the housing 28 and the terminal plate 30 to protect the components of the switch 10 from moisture or corrosive agents such as gasoline. At the opposite end of the switch, an O-ring 194 is interposed between the journal 92 and the web 156 to deter the entry of moisture.

According to a preferred embodiment, the shaft 24, insulator 26, housing 28 and terminal board 30 are all molded from a corrosion resistant plastic such as a glass-filled, UV-stabilized polypropylene sold by Thermofil Corporation or CELCON, sold by Hoechst Celanese. The hermetic seal between the housing 28 and the terminal board 30 may be formed by welding the sides of the two together.

In order to operate the switch 10 as an ignition switch, the key 140 is inserted into the key hole 160 while the switch 10 is in the "off" state. In this state, the switch contact 12 couples the engine magneto and ground terminals 14, 18 and isolates the remaining terminals 16, 20, 22. The key is then turned clockwise, which rotates the shaft 24 and moves the detents 94, 96 across the surface of the reliefs 180, 182 until the "run" position is reached. Rotating the shaft 24 rotates the switch contact 12 relative to the terminals until the contact 12 couples the battery and lights terminals 16, 20 and isolates the remainder. Continuing to rotate the key 140 counterclockwise against the bias of the spring 178 moves the switch contact into the "start" position, in which the starter solenoid and battery terminals 16, 22 are bridged. The shaft 24 returns to the "run" position under the bias of spring 178 once the key is released, and the switch 10 may be returned to the "off" state by rotating the key 140 in the counter-clockwise direction.

The key 140 is preferably formed of metal, but is not limited to the shape shown in FIG. 1. One alternative would be a paddle-shaped key similar to that shown in FIG. 2 of U.S. Pat. No. 3,497,644 to Schink et al., issued Feb. 24, 1970. The key need not be detachable from the switch 10.

The switch 10 as shown in the drawings may be mounted through a socket (not shown) by means of a bezel 200 (FIGS. 1 and 2) which frictionally engages the neck portion 152 of the housing 28. More specifically, the neck portion 152 is passed through a socket having a diameter less than that of the flange 154, so that the flange 154 abuts the rear wall surrounding the socket. The bezel 200 comprises a sleeve 202 which is pressed over the neck portion 152 and a surrounding flange 204 having the same diameter as the flange 154 for abutment against the front wall surrounding the socket. As shown in the drawings, the outer surface of the neck portion 152 is serrated to engage one or more integral catches 206 (one shown in FIG. 2) to secure the housing 28 and bezel 200 together. The neck portion includes a flat 208 (FIG. 4), which engages a corresponding flat in the socket to orient the switch 10 with an external circuit to which it is to be connected.

Alternatively, the outer surface of the neck portion 152 of the housing 28 may be threaded, so that the neck portion 152 may be secured in a socket (not shown) by means of an appropriately sized nut. This mounting technique has the advantage of replacing a custom-made plastic molding (the bezel 200) with a commercially available part (the nut), thereby reducing the inventory of custom-made components required in connection with the switch 10.

Figure 15:
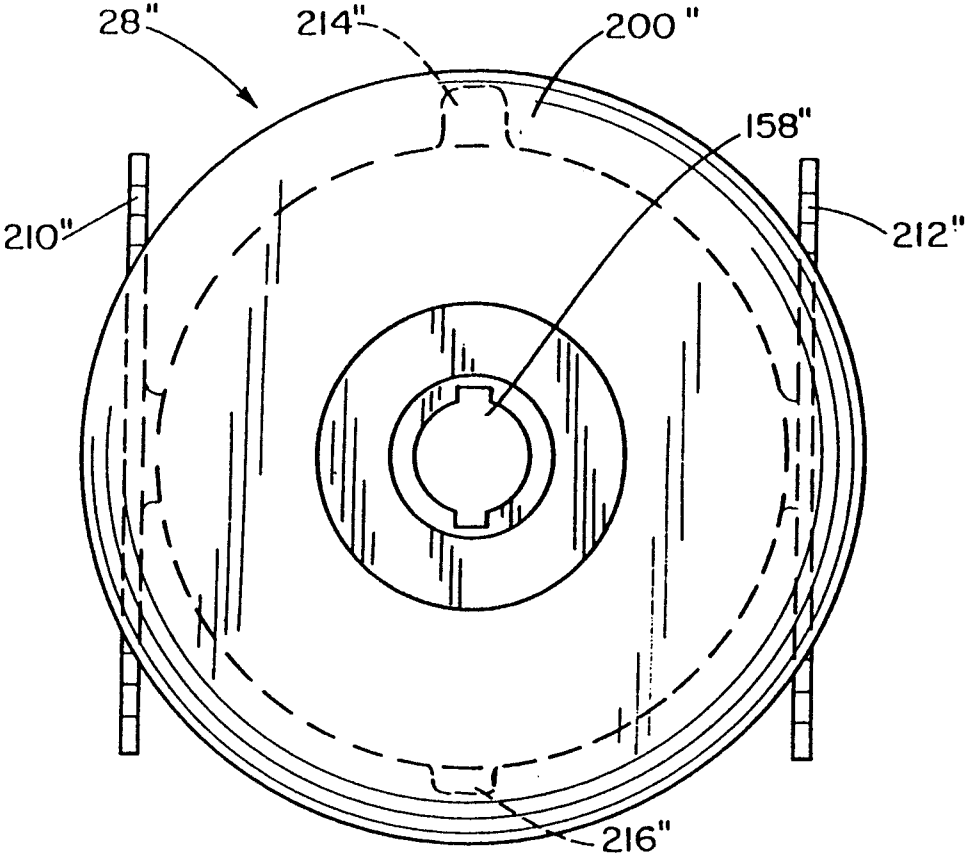
FIGS. 14 and 15 are elevational views of an alternative housing for a key switch.
Figure 14:
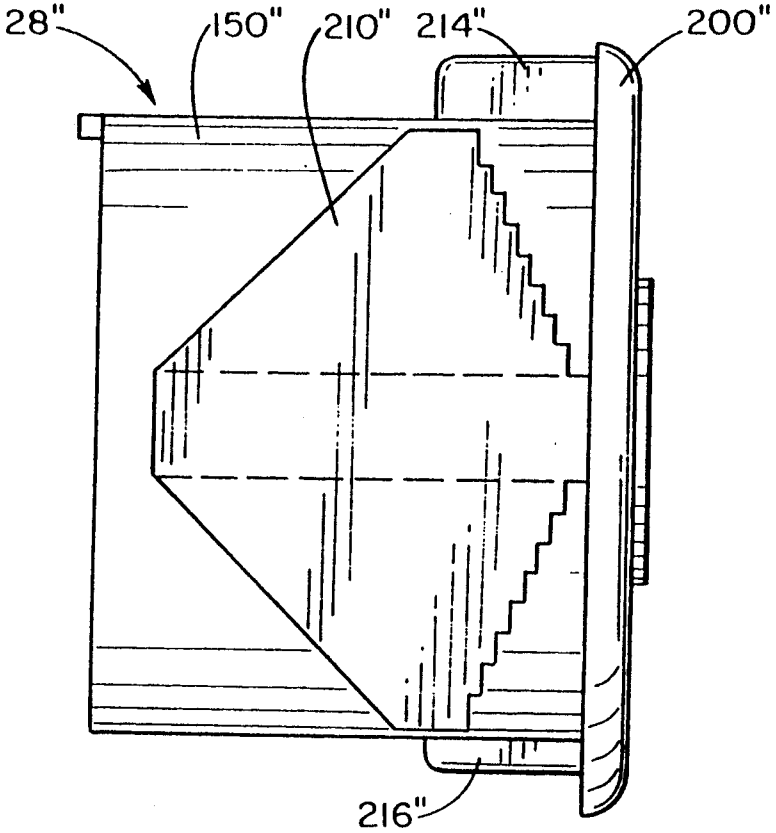

Yet another alternative embodiment of the housing 28" (FIGS. 14 and 15) consists of a body portion 150"

and an integral bezel 200" having a central opening 158" for receiving a key (not shown). Two pairs of resilient wings 210", 212" are formed on each side of the body portion 150" and cooperate with the integral bezel 200" to secure the housing 28" in a socket (not shown) having a diameter larger than that of the body portion 150". During installation of the housing 28" in such socket, the wings 210", 212" are pressed against the outer surface of the body portion 150" while the body portion 150" is pushed through the socket from the front. The body portion 150" also mounts a pair of integral non-symmetric keys 214", 216" which cooperate with matching slots in the sides of such socket (not shown) to properly orient the housing 28" with respect to an external circuit.

Many modifications and variations of the invention will be apparent to those skilled in the art in light of the foregoing detailed disclosure. Therefore, it is to be understood that, within the scope of the appended claims, the invention may be practiced otherwise than as specifically shown and described.

I claim:

1. A switch comprising:

a) a disc-shaped electrically-conductive switch contact having a generally planar contact surface;

b) a shaft coupled to said switch contact and having a key hole for receiving a key and transferring rotary motion from such a key to said switch contact and cause the switch contact to rotate back and forth about a rotation axis as the key is rotated;

c) a housing for enclosing the switch contact, rotatably supporting said shaft, and positioning said key-hole for insertion of such a key;

d) terminals of identical structure, each comprising a prong extending through a housing wall for engagement with an external circuit, a head extending perpendicularly away from said prong into the housing and a dome mounted on said head for contact with said switch contact;

e) said switch contact including at least one arcuate cut-out concentric with said axis such that at least two of said terminals are bridged in one angular orientation of said switch contact and one of those two terminals is isolated from the switch contact by the cut-out in another angular orientation of said switch contact;

f) a pair of diametrically-opposed detents fixed on said shaft and a pair of reliefs fixed on an inner surface of said housing, said reliefs being positioned so that said detents abut one side of each relief when said switch contact is in said one angular orientation and an opposite side of each relief when said switch contact is rotated to said other angular orientation; and g) a spring for biasing said diametrically opposed detents on the shaft toward said inner surface of said housing and said generally planar contact surface of the switch contact toward said terminals, whereby said switch contact is stabilized by engagement between the detents and reliefs when in said one angular orientation and in said other angular orientation.

2. A switch according to claim 1 in which said shaft includes a tab extending into a channel in said inner surface of said housing, one end of which channel acts as a stop to limit the rotation of said shaft.

3. A switch comprising:

a) a rotatably supported shaft;

b) an electrically conductive switch contact supported for back-and-forth rotation with the shaft about an axis of rotation between first and second angular orientations of the switch contact relative to the axis of rotation;

c) at least three electrically conductive terminals, each terminal having i) a prong, and ii) a projection rigidly connected to the prong defining a raised surface for contact with the switch contact;

d) positioning means supporting the prongs of the conductive terminals to position the raised surfaces of the terminals for electrical contact with the switch contact in at least one of its angular orientations, such that a radius from the axis of rotation of the switch contact to a region of engagement with the raised surface of one of the terminals is different from a radius from the axis of rotation to a region of engagement with the raised surface of another of the terminals;

e) a stop cooperating with the shaft to define a third angular orientation of the switch contact; and f) a spring acting eccentrically on the shaft for biasing the shaft to turn the switch contact away from the third angular orientation toward one of the first and second angular orientations;

g) wherein the switch contact is an electrically conductive disc having at least two arcuate cut-outs concentric with the axis of rotation of the switch contact at different radii from the axis of rotation; so that the switch contact isolates i) at least one of the terminals from contact with the switch contact in the second angular orientation of the switch contact, ii) and isolates another of the terminals from contact with the switch contact in the third angular orientation of the switch contact.

4. A switch comprising:

a) a housing including a body portion and a neck portion having an opening for receiving a key;

b) a shaft rotatably supported by the neck portion and extending into the body portion, wherein the shaft includes a hole communicating with the opening in the neck portion for engagement with such key;

c) an insulator supported by the shaft for rotation with the shaft and sliding movement along the axis relative to the shaft;

d) a switch contact fixed to the insulator for back-and-forth rotation with the shaft and insulator around an axis, said switch contact having a conductive contact surface;

e) cooperative detents positioned on a surface of the shaft facing away from the switch contact and on a surface of the housing to define the first and second angular orientations of the switch contact;

f) at least two terminals positioned at least partially within the body portion of the housing for contact with the contact surface of the switch contact in at least one of the first and second angular orientations of the switch contact; and g) a spring positioned between the shaft and insulator to bias the cooperative detents together and to bias the switch contact toward the terminals.

5. A switch according to claim 4 wherein the cooperative detents include reliefs projecting from the surfaces of the shaft and the housing.

6. A switch according to claim 4 wherein the cooperative detents include at least one wedge-shaped relief projecting from the surface of the housing and at least one relief projecting from the surface of the shaft.

7. A switch according to claim 4 wherein the terminals are positioned by a terminal board fixed to the housing so as to close an end of the body portion opposite the neck portion.

8. A switch according to claim 4 including an additional spring acting on the shaft eccentrically with respect to the axis of the switch contact for increasing the engagement force between the cooperative detents.

* * * * *